US008991225B2

(12) United States Patent
Wu et al.

(10) Patent No.: US 8,991,225 B2
(45) Date of Patent: Mar. 31, 2015

(54) BURGLARPROOF DEVICE FOR ELECTRONIC DEVICE

(71) Applicant: Sinox Co., Ltd, Taipei (TW)

(72) Inventors: Chia-Ming Wu, New Taipei (TW); Chun-Sheng Wu, Taipei (TW)

(73) Assignee: Sinox Co., Ltd., New Taipei (TW)

( * ) Notice: Subject to any disclaimer, the term of this patent is extended or adjusted under 35 U.S.C. 154(b) by 0 days.

(21) Appl. No.: 13/970,121

(22) Filed: Aug. 19, 2013

(65) Prior Publication Data

US 2014/0069153 A1 Mar. 13, 2014

Related U.S. Application Data

(60) Provisional application No. 61/698,181, filed on Sep. 7, 2012, provisional application No. 61/691,005, filed on Aug. 20, 2012.

(51) Int. Cl.
*E05B 73/00* (2006.01)
*E05B 37/02* (2006.01)

(52) U.S. Cl.
CPC ..... *E05B 73/0082* (2013.01); *E05B 37/02* (2013.01); *E05B 73/0005* (2013.01)
USPC ..... 70/58; 70/14; 70/18

(58) Field of Classification Search
USPC ..... 70/14, 18, 57–58
See application file for complete search history.

(56) References Cited

U.S. PATENT DOCUMENTS

| | | | | |
|---|---|---|---|---|
| 5,791,171 | A * | 8/1998 | Kelley | 70/58 |
| 6,058,744 | A * | 5/2000 | Ling | 70/28 |
| 6,619,081 | B1 * | 9/2003 | Yu | 70/58 |
| 6,918,272 | B1 * | 7/2005 | Sanders | 70/58 |
| 7,234,326 | B1 * | 6/2007 | Lu | 70/58 |
| 7,302,816 | B1 * | 12/2007 | Lu | 70/58 |
| 7,401,481 | B1 * | 7/2008 | Lin | 70/14 |
| 2008/0034816 | A1 * | 2/2008 | Lu | 70/58 |

* cited by examiner

*Primary Examiner* — Christopher Boswell
(74) *Attorney, Agent, or Firm* — Birch, Stewart, Kolasch & Birch, LLP

(57) ABSTRACT

A burglarproof device for electronic device including a fastener, a control unit, and a lock core is provided. The fastener includes a plurality of lever arms surrounding a virtual axis. The control unit moves relative to the fastener and drives ends of the lever arms to move toward each other when approaching the fastener; the ends of the lever arms move away from each other when the control unit leaves the fastener. The lock core in an unlocked status permits the movement of the control unit relative to the fastener while the lock core in a locked status restricts the control unit from moving relative to the fastener.

24 Claims, 15 Drawing Sheets

BURGLARPROOF DEVICE FOR ELECTRONIC DEVICE

BACKGROUND OF THE INVENTION

1. Field of the Invention

The present invention generally relates to a burglarproof device. Particularly, the present invention relates to a burglarproof device for electronic device.

2. Description of the Prior Art

Consumer electronic products play a very important role in the modern life. Fast lifestyle and eagerness for instant information make portable electronic devices become a necessity to most people. However, since these portable devices are in high demand, wide spread, high unit price, small volume, and high portability and become more and more popular, the possibility of being stolen or lost accordingly increases.

One type of locks, which is developed to against thieves, is connected to the electronic product, wherein the lock is specifically connected to the electronic product via the fastener thereof into a lock hole on the electronic product. The electronic product connected to the lock is secured and locked by the fastener through a locking operation.

SUMMARY OF THE INVENTION

It is an object of the present invention to provide a burglarproof device for electronic device, the burglar device having a fastener that is easy to operate and better in securing.

The burglarproof device for electronic device of the present invention includes a fastener, a control unit, and a lock core. The fastener includes a plurality of lever arms surrounding a virtual axis. The control unit moves relative to the fastener and drives ends of the lever arms to move toward each other when the control unit approaches the fastener. The ends of the lever arms move away from each other when the control unit leaves the fastener. The unlocked lock core permits the movement of the control unit relative to the fastener while the locked lock core restricts the control unit from moving relative to the fastener. For example, the locking operation of the lock core drives the control unit to move toward the fastener, and the unlocking operation of the lock core drives the control unit to move away from the fastener.

The burglarproof device for electronic device of the present invention includes a fastener, a control unit, and a lock core. The fastener includes a plurality of lever arms surrounding a virtual axis. The control unit moves relative to the fastener and has a guiding surface, wherein the guiding surface guides ends of the lever arms to move along the guiding surface and toward each other when the control unit approaches the fastener; the ends of the lever arms move away from each other when the control unit leaves the fastener. A locking operation for the lock core drives the control unit to approach the fastener while an unlocking operation for the lock core drives the control unit to leave the fastener.

The burglarproof device for electronic device of the present invention includes a fastener, a control unit, an operating device, and a lock core. The fastener includes a plurality of lever arms surrounding a virtual axis. The control unit moves relative to the fastener and has a guiding surface, wherein the guiding surface guides ends of the lever arms to move along the guiding surface and toward each other when the control unit approaches the fastener; the ends of the lever arms move away from each other when the control unit leaves the fastener. The operating device drives the control unit to move relative to the fastener. The unlocking operation of the lock core releases the operating device while the locking operation of the lock core restricts the operating device.

DETAILED DESCRIPTION OF THE PREFERRED EMBODIMENT

Hereinafter, embodiments of the burglarproof device of the present invention are illustrated in detail with reference to the drawings.

The orientation recited in the specification such as upper, lower, left, and right corresponds to the orientation shown in the figures. When the orientation of the burglarproof device is changed, the relations among the members are not changed.

Figure 15:
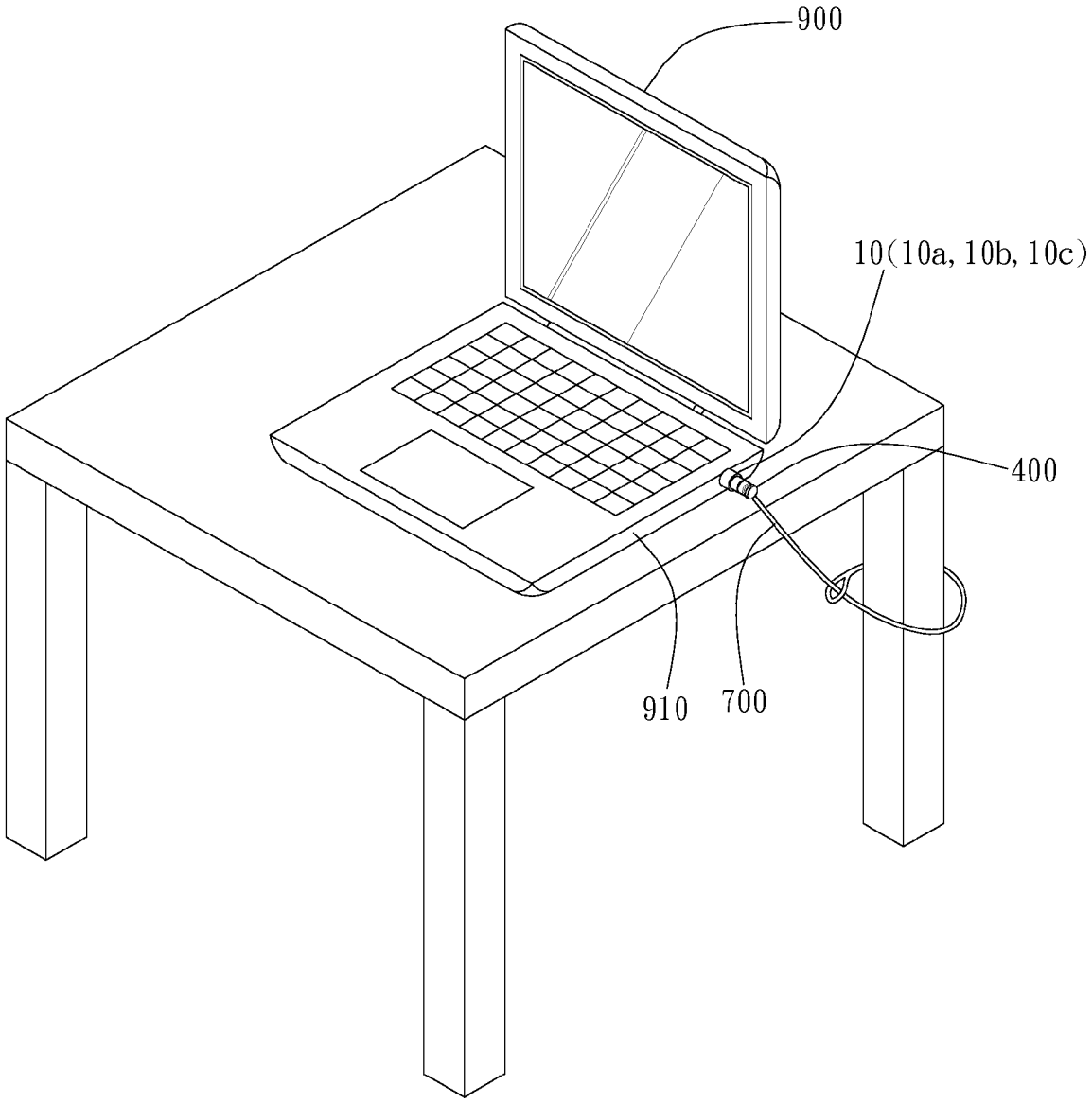
FIG. 15 is a schematic view of the burglarproof device of the present invention in use.

As FIG. 15 shows, the burglarproof device 10 of the present invention may be used in coordination with a flexible member 700 such as cable and chain to tie an electronic device 900 to furniture, a portable and storageable object, or a vehicle, etc. to be prevented from stealing. The electronic device 900 shown in the figure is a notebook computer but is not limited thereto; the electronic device mentioned in the specification may be such as a tablet computer, a digital camera, and the like. The electronic device may have a hole having a shape of rectangular, circle, ellipse, or any geometry formed on a housing 910 thereof.

Figure 1:
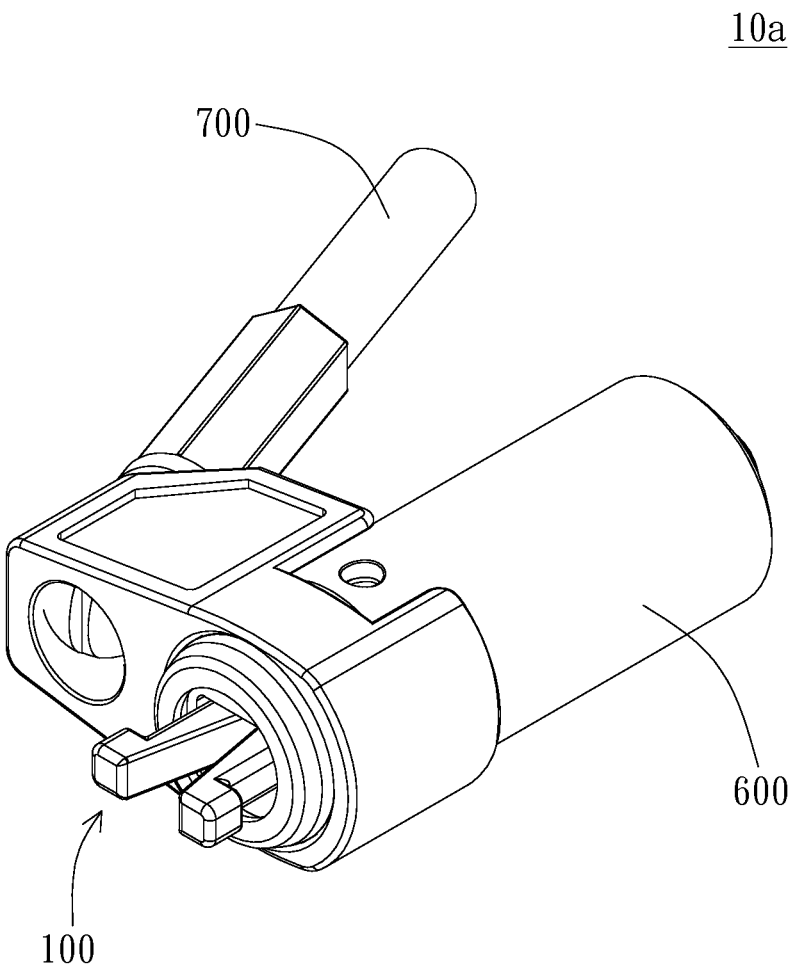
FIG. 1 shows a three-dimensional view of the first embodiment of the burglarproof device of the present invention.
Figure 2:
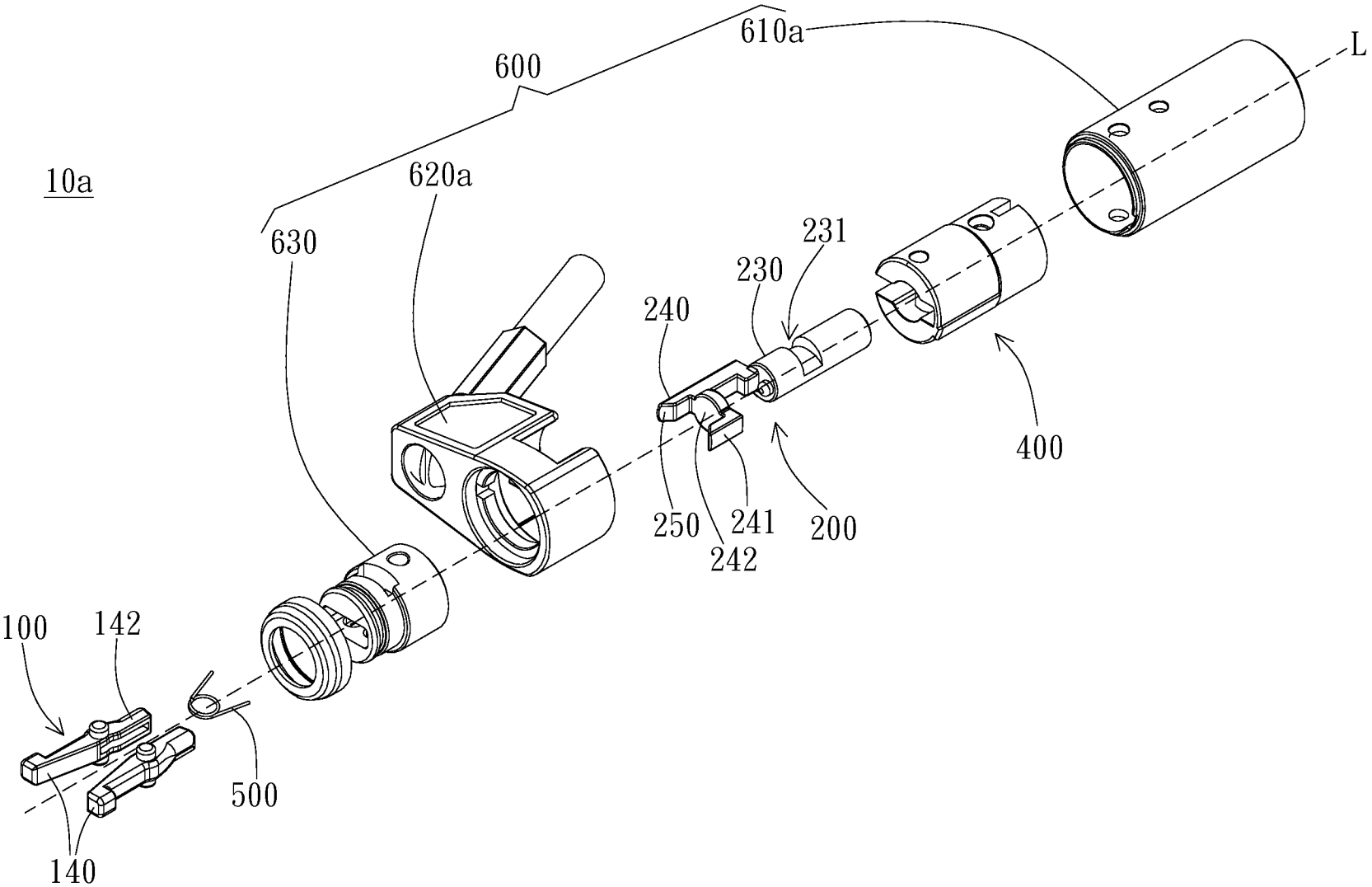
FIG. 2 shows an exploded view of the first embodiment of the burglarproof device of the present invention.

As FIG. 1 and FIG. 2 show, the burglarproof device 10*a* of the present invention has a fastener 100, a control unit 200, a lock core 400, and a housing 600. The fastener 100 is controlled to be in a connecting-permissible status or a locked status (i.e. controlling the burglarproof device 10*a* to be in the connecting-permissible status or the locked status; wherein the connecting-permissible status is generally a status in which the fastener 100 may be connected to, inserted into, or attached to the above-mentioned hole of the electronic device, and vice versa, i.e. the fastener 100 may also be disconnected from, pulled out of, or detached from the above-mentioned hole of the electronic device) by means of relative movements of the fastener 100 and the control unit 200, especially the control unit 200 moving toward or away from the fastener 100. An unlocking or a locking operation of the lock core 400 may be operated along with the movement of the control unit 200. Alternatively, an unlocked status of the lock core 400 permits the movement of the control unit 200, and a locked status of the lock core 400 restricts the movement of the control unit 200. In the first embodiment of the present invention shown in FIG. 1 and FIG. 2, the lock core 400 is a key lock.

On the other hand, the housing 600 primarily includes a first housing 610*a*, a second housing 620*a*, and a sleeve 630. The sleeve 630 has a tubular shape and is able to enclose a portion of the fastener 100, wherein a portion of the fastener 100 is exposed for entering or leaving a hole 911 formed on a housing 910 of the electronic device. The first housing 610*a* encloses a portion of the fastener 100, the control unit 200, and the lock core 400. The second housing 620*a* may be provided, for example, for the flexible member 700 such as a cable or a chain to be disposed thereon.

Figure 3A:
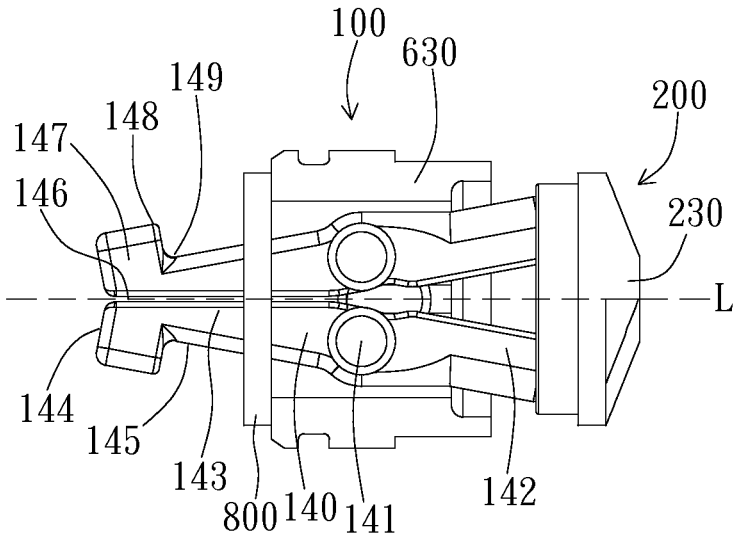
FIG. 3A is a side view of a combination of the fastener, the sleeve, and a portion of the control unit of the first embodiment of the burglarproof device of the present invention in the connecting-permissible status (the original status)
Figure 3B:
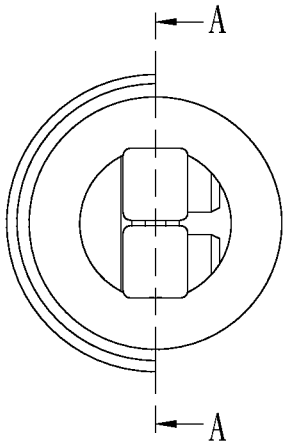
FIG. 3B is a front view of the combination shown in FIG. 3A.
Figure 3C:
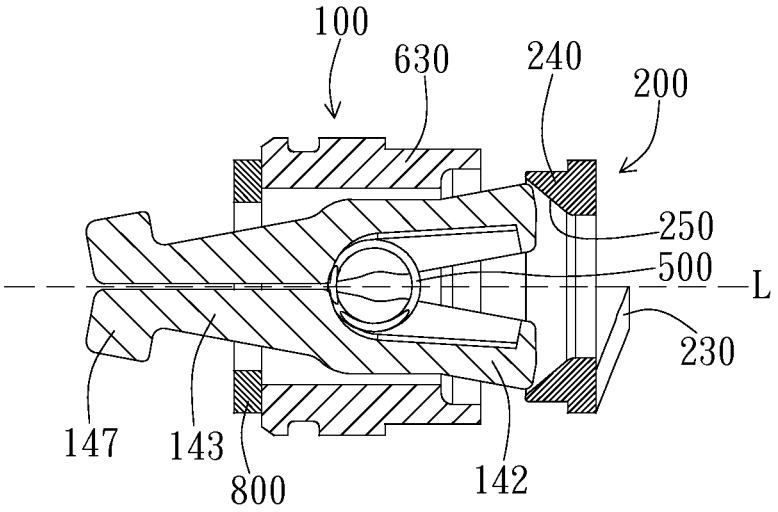
FIG. 3C is a cross-sectional view along the cross-sectional line AA in FIG. 3B.
Figure 4:
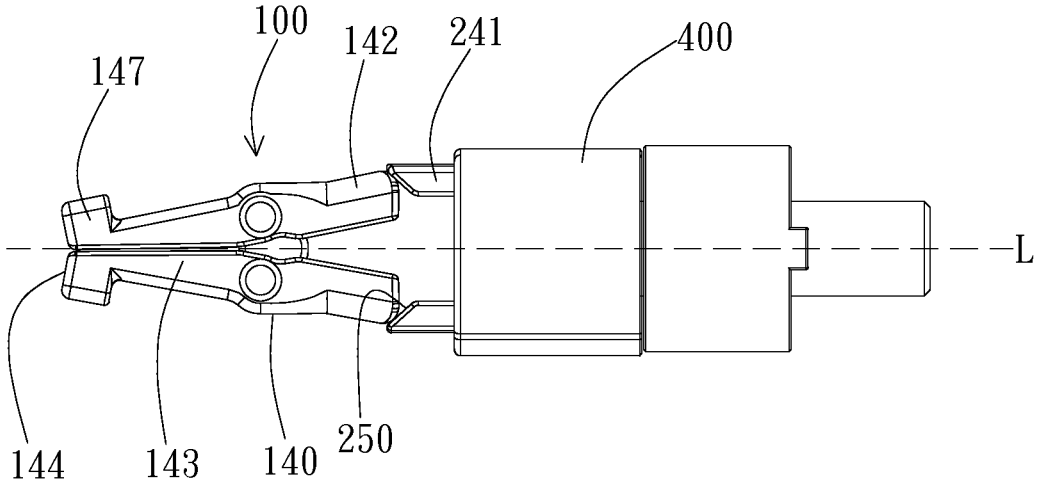
FIG. 4 is a side view of the first embodiment of the burglarproof device of the present invention in the connecting-permissible status (the original status) with the housing being removed.
Figure 5A:
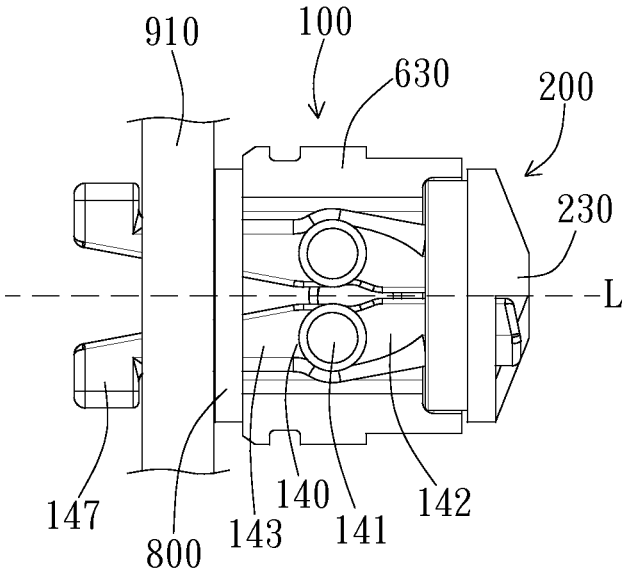
FIG. 5A is a side view of a combination of the fastener, the sleeve, and a portion of the control unit of the first embodiment of the burglarproof device of the present invention in the locked status.
Figure 5B:
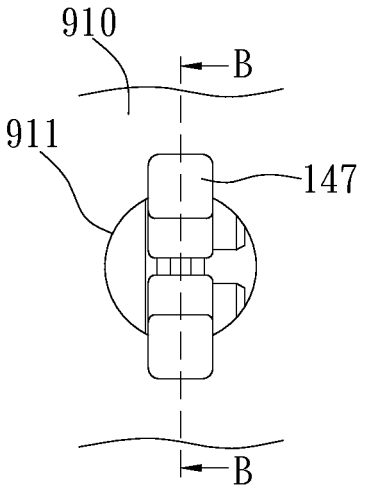
FIG. 5B is a front view of the combination shown in FIG. 5A.
Figure 5C:
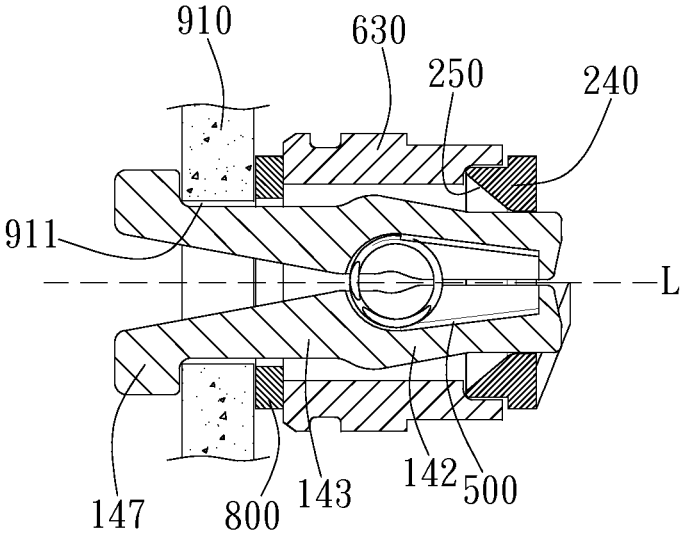
FIG. 5C is a cross-sectional view along the cross-sectional line BB in FIG. 5B.
Figure 6:
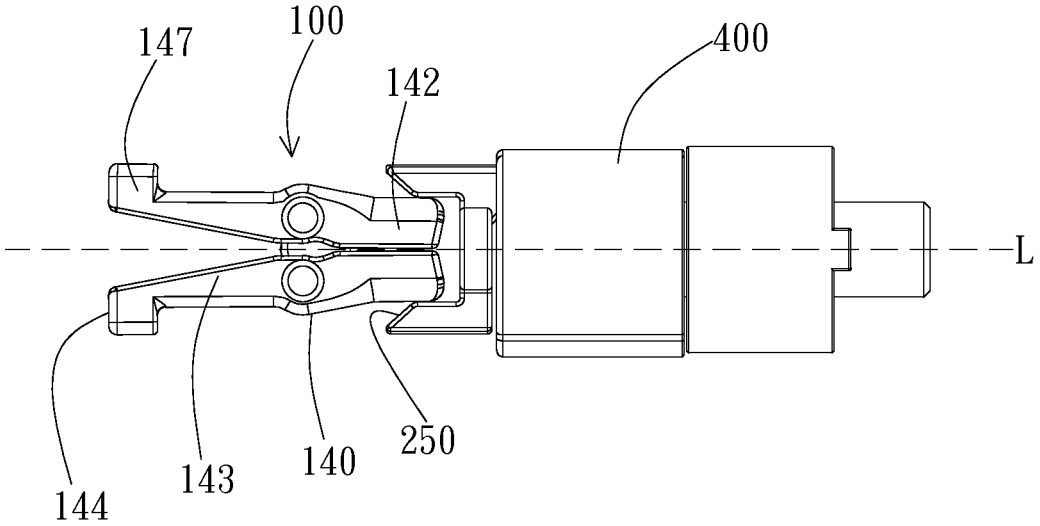
FIG. 6 is a side view of the first embodiment of the burglarproof device of the present invention in the locked status with the housing being removed.

The fastener 100 of the burglarproof device 10*a* includes a plurality of lever arms 140 received in the sleeve 630. As shown in FIG. 2 and FIG. 3A, the sleeve 630 has the tubular shape but is not limited thereto. The sleeve 630 may have other shapes as long as a plurality of lever arms can be moveably received therein without being interfered by the sleeve 630. In order to demonstrate the movement of the plurality of lever arms 140, a cross-sectional view of the sleeve 630 is shown in FIG. 3C, wherein it is noted that the sleeve 630 substantially encloses/surrounds the plurality of lever arms 140.

Each of the lever arms 140 has a pivot 141, an effort arm 142 beside the pivot 141, and a resistance arm 143 beside the pivot 141 and opposite to the effort arm 142. The effort arm 142, the pivot 141, and the resistance arm 143 can constitute a flat V shape so that the a free end of the effort arm 142 and a front end 144 of the resistance arm 143 have a longer displacement, wherein the pivot 141 is at the bottom of the V shape, the effort arm 142 and the resistance 143 preferably tilt from the pivot 141 and toward the same direction.

The number of the lever arms 140 is not limited. For example, the number of the lever arms 140 could be two, three, four, five, etc. (two lever arms 140 are shown in the figure). However, it is preferred that the lever arms 140 evenly surround a virtual axis L. Meanwhile, the pivots 141 of the lever arms 140 are close to each other and surround the virtual axis L. The effort arms 142 and the resistance arms 143 are at the same orientation, respectively. Furthermore, a side of the lever arm 140 facing the virtual axis L is defined as an inner side 146 while the reverse side thereof is defined as an outer side 145. The outer side 145 of the front end 144 of the resistance arm 143 has a projection 147 formed thereon. An end of the projection 148 forms a hook portion 149. The plurality of lever arms 140 in the status mentioned above, i.e. surrounding the virtual axis L, are received in the tubular sleeve 630. The plurality of effort arms 142 extends out of the sleeve 630 from an orifice at one end (the rear end) of the sleeve 630 while the plurality of resistance arms 143 extends out of the sleeve 630 from another orifice at the other end (the front end) of the sleeve 630, wherein a distance between the projection 147 and the orifice of the other end (the front end) of the sleeve 630 is at least equal to a thickness of the housing 910 of the electronic device 900 around the hole 911. In addition, the virtual axis L and the axis of the sleeve 630 are preferably coaxial.

An elastic member 500 is disposed among the plurality of effort arms 142 and applies force to the effort arms 142 evenly so that the free ends of the effort arms 142 are distant from each other. In the case shown in the figure that the number of the lever arms 140 is two, the elastic member 500 may be a torsional spring made of steel wire. In other cases that the number of the lever arms 140 is three or greater, the elastic member 500 may be a bead made of elastic material such as rubber and is clamped by the effort arms 142.

The control unit 200 is next to the rear end of the fastener 100 and includes a connecting portion 230 and a guiding surface 250. The connecting portion 230 is for connecting the control unit 200 and the above-mentioned lock core/key lock 400. By operating the key lock 400, the control unit 200 may move relative to the fastener 100 along the virtual axis L to approach or leave the fastener 100. The guiding surface 250 is located on a side of the control unit 200 that faces the fastener 100 and is a conical surface or an oblique plane sloping towards the virtual axis L and away from the fastener 100. In addition, the guiding surface 250 may be a flat surface or a curved surface such as an arc surface.

Further speaking, the control unit 200 includes a connecting portion 230 and a controlling portion 240. As FIG. 2 shows, the connecting portion 230 is a shaft, which has a recess 231 formed thereon for receiving such as a moveable pin (not shown). The lock core/key lock 400 is operated in cooperation with the shaft 230 and the members disposed thereon such as the moveable pin to achieve the unlocked or the locked status.

The controlling portion 240 operates the fastener 100 to be in the connecting-permissible status or the locked status. The controlling portion 240 may include a structure of wedge block as shown in the figure; the above-mentioned guiding surface 250 is the oblique plane of the wedge block 241. For example, the controlling portion 240 of the embodiment further includes a disc 242. At least two wedge blocks 241 are disposed on an edge of the disc 242 in a way of the oblique planes of the wedge blocks 241 facing each other, and corresponding to the effort arms 142 of the above-mentioned two lever arms 140, respectively. In addition, an interval between the two wedge blocks 241 is preferably greater than a sum of length of the free ends of the two effort arms 142 along a direction perpendicular to the virtual axis L.

When the burglarproof device 10*a* is in the connecting-permissible status, as shown in FIGS. 3A-3C and FIG. 4, the elastic member 500 enables the free ends of the effort arms 142 of the plurality of lever arms 140 to be away from each other, i.e. the front ends 144 of the resistance arms 143 approach each other. Meanwhile, the projections 147 located at the front ends 144 of the plurality of resistance arms 143 gather at the virtual axis L so that a shape and a diameter of the gathering projections 147 in a radial direction with respect to the virtual axis L allow the projections 147 to get across the hole 911 of the housing 910 of the electronic device. Under such condition, the fastener 100 is able to enter or leave the hole 911 of the housing 910 of the electronic device by the resistance arms 143 having the projections 147 on the front ends 144. In the embodiment, the connecting-permissible status is also an original status of the burglarproof device 10*a*.

When the fastener 100 of the burglarproof device 10*a* having its resistance arms 143 entering the hole 911 of the housing 910 of the electronic device, it is ready to proceed with a locking operation. Please refer to FIG. 4 and then FIG. 6, operating the key lock 400 will drive the control unit 200 through the connecting portion 230, which results in the control unit 200 moving relative to the fastener 100 to approach the fastener 100. Meanwhile, the guiding surface 250 of the control unit 200 contacts the free ends of the effort arms 142. Since the control unit 200 is continued to be driven by the above-mentioned key lock 400 to move relative to the fastener 100 along the virtual axis L and approach the fastener 100, the guiding surface 250 pushes against the free ends of the plurality of effort arms 142 so that the effort arms 142 move along the guiding surfaces 250 and simultaneously approach to each other. In other words, two effort arms 142 gradually gather together between the two wedge blocks 241, as shown in FIGS. 5A-5C and 6. Since the free ends of the effort arms 142 approach to each other, the elastic member 500 disposed among the plurality of effort arms 142 are therefore compressed by the effort arms 142 and deformed with a restoring force for returning to an initial status.

On the other hand, since the free ends of the effort arms 142 of the plurality of lever arms 140 move along the guiding surfaces 250 and simultaneously approach to each other, the front ends 144 of the resistance arms 143 move away from each other, wherein the plurality of projections 147 previously gathering at the virtual axis L spread radially. When the fastener 100, especially the resistance arm 143 of the lever arm 140 has been inserted into the hole 911, the ends of the projections 148 spread to a degree of not able to be pulled out of the hole 911 of the housing 910 of the electronic device, and the housing 910 of the electronic device interferes with the hook portion 149. In other words, the burglarproof device 10*a* is in the locked status and unable to be disengaged from the hole 911 of the housing 910.

In order to release the burglarproof device 10*a* from the locked status to the connecting-permissible and unlocked status, the above-mentioned lock core 400 of key lock is operated to drive the connecting portion 230 of the control unit 200, which makes the control unit 200 to move along the virtual axis L and away from the fastener 100. For example, using a key to operate a rotation of a bead seat of the lock core 400 enables the moveable pin to move along the recess 231 on the shaft 230 and contract, in other words, making the shaft 230 disengage from a secured status and move. Meanwhile, the wedge block 241 and the guiding surface 250 also move away from the free ends of the effort arms 142. When the guiding surface 250 does not interfere with the free ends of the effort arms 142, the confinement of the free ends of the effort arms 142 are released and the elastic member 500 returns to the initial status due to the restoring force and pushes the effort arms 142 to be restored to its original status of being far away from each other. On the other hand, the projections 147 located at the front ends 144 of the plurality of resistance arms 143 come closer to the virtual axis L again to reach a state that is able to be in and out of the hole 911 of the housing 910 of the electronic device. At this time, the burglarproof device 10*a* is allowed to be detached from the hole 911 of the housing 910 of the electronic device so that the electronic device is released.

Alternatively, the lock core 400 of key lock need not drive directly the connecting portion 230 as long as the forced exerted on the fastener 100 by the connecting portion 230 is released, e.g. by releasing the restoring force of the elastic member. Since the elasticity of the elastic member 500 pushes the effort arms 142, the free ends of the effort arms 142 are restored to the original status of being far away from each other. Meanwhile, the free end of the effort arm 142 pushes the guiding surface 250 so that the connecting portion 230 moves away from the fastener 100. The unlocking operation is therefore easily accomplished.

In view of the above description, it is comprehended that the distance between the projection 147 and the orifice of the front end of the sleeve 630 is at least equal to the thickness of the housing 910 of the electronic device 900 around the hole 911. Since the thickness of the housing 910 of electronic devices varies, a pad 800 of may be disposed in front of the housing 600 if there is a gap formed between a front end of the housing 600 and the electronic device and needed to be filled. The pad 800 may be formed of elastic material such as rubber or PVA, which may deform in accordance with the gap between the front end of the housing 600 and the electronic device to substantially fill the gap.

Figure 7A:
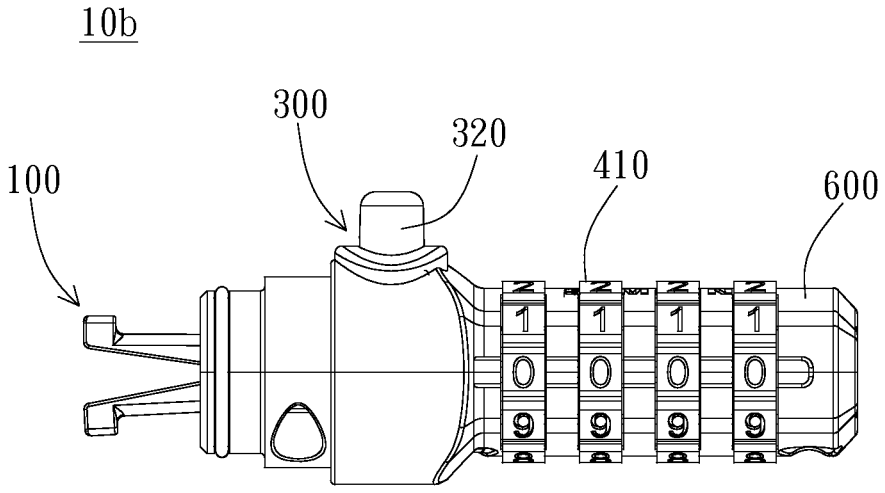
FIG. 7A and FIG. 7B are schematic views of the appearance of the second embodiment of the burglarproof device of the present invention in the original and the connecting-permissible status, respectively.
Figure 7B:
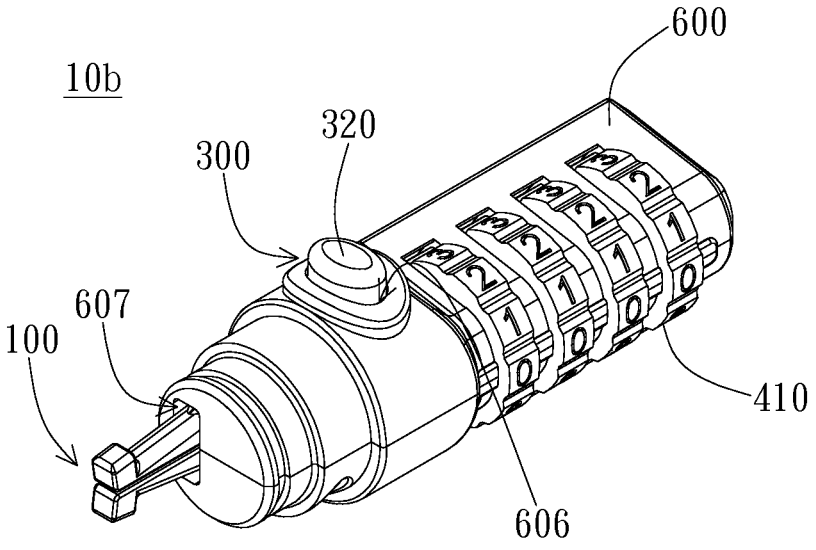
Figure 8:
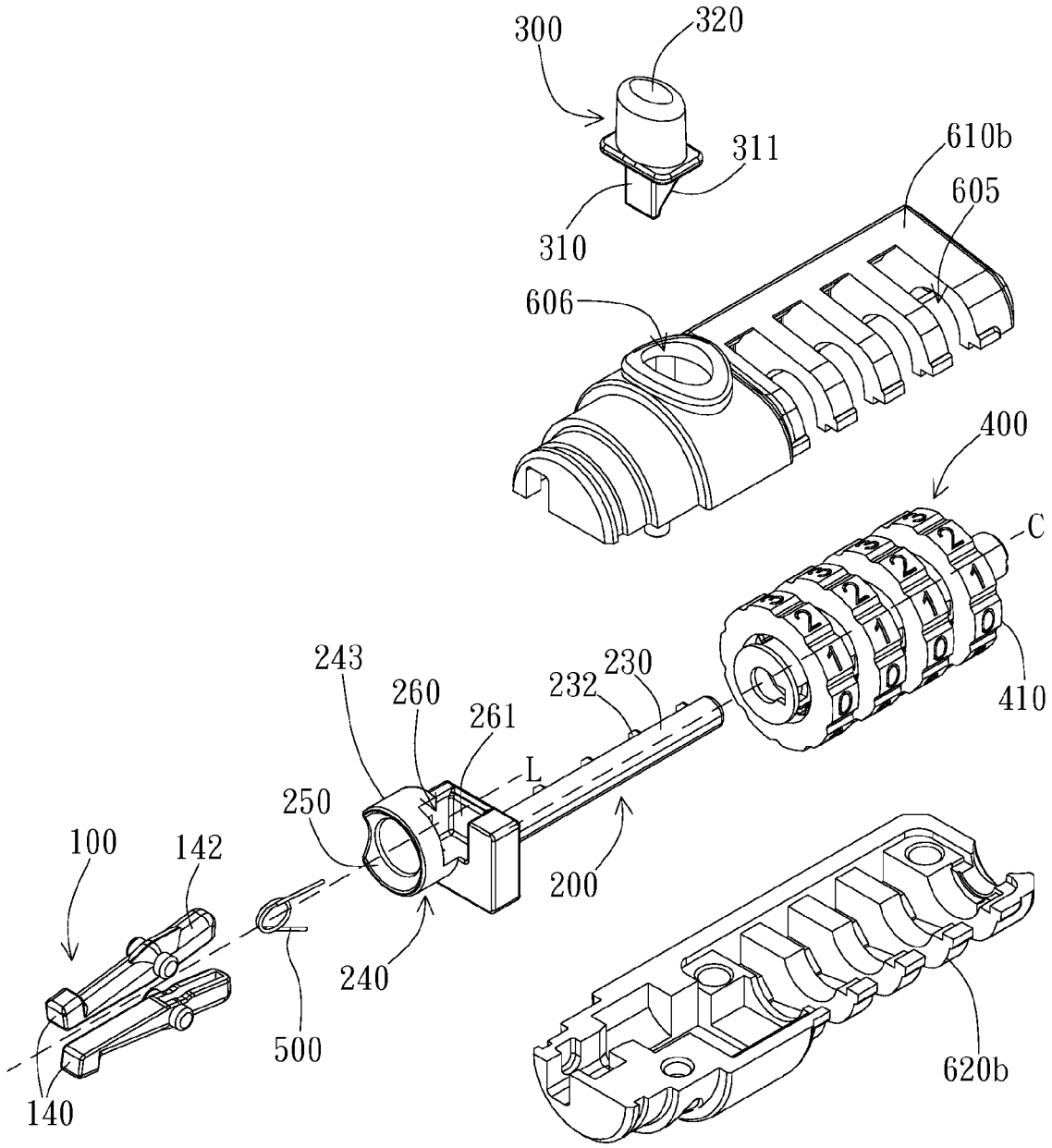
FIG. 8 is an exploded view of the second embodiment of the burglarproof device of the present invention.

In another embodiment of the present invention, as shown in FIGS. 7A-7B and FIG. 8, the burglarproof device 10*b* has the fastener 100, the control unit 200, a lock core of combination lock 400, the housing 600, and an operating device 300, wherein the housing 600 includes a first housing 610*b* and a second housing 620*b*. The first housing 610*b* and the second housing 620*b* face each other, move toward the virtual axis L to combine and form an accommodation space for receiving the control unit 200, the lock core 400, and a portion of the fastener 100. At least one of the first housing 610*b* and the second housing 620*b* has a hole 605 and a first through hole 606. The hole 605 is for dial(s) 410 of the lock core 400 of the combination lock to be exposed while the first through hole 606 is for the operating device 300 to be exposed for an user's operating. On the other hand, the combination of the first housing 610*b* and the second housing 620*b* also form a second through hole 607 communicating with the accommodation space. The second through hole 607 may be for the resistance arm 143 of the lever arm 140 of the fastener 100 to extend out and get across the hole 911 of the housing 910 of the electronic device. The second through hole 607 is equal to the orifice of the front end of the sleeve 630 in the previous embodiment.

As mentioned above, the fastener 100 of the embodiment includes a plurality of lever arms 140 received in a front portion of the housing 600 close to the second through hole 607. The elastic member 500 is disposed among the effort arms 142 of the plurality of the lever arms 140.

The control unit 200 is disposed next to the rear end of the fastener 100 and includes the connecting portion 230 and the guiding surface 250. The connecting portion 230 is connected with the lock core 400 of combination lock. By means of an unlocking operation or a locking operation, the lock core 400 of combination lock allows or restricts movements of the control unit 200 relative to the fastener 100 and along the virtual axis L. The guiding surface 250 is located on a side of the control unit 200 that faces the fastener 100 and may be a conical surface or an oblique plane sloping towards the virtual axis L and away from the fastener 100. In addition, the guiding surface 250 may be a flat surface or a curved surface such as an arc surface.

Further speaking, the control unit 200 includes the connecting portion 230, the controlling portion 240, and the driven portion 260. As shown in FIG. 8, the connecting portion 230 is a shaft, which has a plurality of teeth 232 formed on a surface thereof for cooperating with the lock core 400 to perform the unlock or lock operation. In addition, when the lock core 400 is unlocking, the shaft may move along an axis C; the axis C may be on the virtual axis L; alternatively, the axis C may be shifted away from the virtual axis L and parallel to the virtual axis L. In the embodiment, it is preferred that the axis C and the virtual axis L are substantially parallel to each other.

The controlling portion 240 controls the fastener 100 to be in the connecting-permissible status or the locked status. The controlling portion 240 may include a tubular structure. A cylindrical tube 243 has one end facing the fastener 100, wherein an inner side thereof is formed as an inner wall of a funnel, wherein the inner wall is drawn close in a direction away from the fastener 100 and serves as the guiding surface 250. The inner wall of the funnel 250 also corresponds to the effort arms 142 of the lever arms 140, as described above. In addition, the cylindrical tube 243 has an inner wall connected to a narrower end of the funnel 250 (i.e. the end where the inner wall drawn close), where the cylindrical tube 243 has an inner diameter preferably greater than the sum of length of the free ends of the two effort arms 142 along a direction perpendicular to the virtual axis L.

The driven portion 260 may interact with the operating device 300 of the embodiment. The operating device 300 may have a structure such as button, knob, switch, or rotary disc exposed from the first through hole 606 for the user touching and operating. Additionally, the operating device 300 may have a driving portion 310 entering the accommodation space formed by the housing 600 and interacting with the control unit 200 or the lock core 400. In the embodiment, the operating device 300 has the driving portion 310 formed as a wedge block for interacting with the control unit 200 through the driven portion 260.

The driven portion 260 is a slot formed in the control unit 200. The slot 260 corresponds to the driving portion 310 and is able to receive at least a portion of the driving portion 310. An oblique plane 311 of the driving portion/wedge block 310 may contact with a slot wall 261 of the slot 260. In the embodiment, a displacement of the driving portion/wedge block 310 perpendicular to the virtual axis L and toward the slot 260 makes the control unit 200 move along the virtual axis L and away from the fastener 100 (the shaft 230 moves along the axis C) by means of the oblique plane 311 pushing against the slot wall 261. Alternatively, when the control unit 200 is unable to move along the virtual axis L, the oblique plane 311 of the wedge block 310 contacts against the slot wall 261 of the slot 260 so that the wedge block 310 cannot move toward the slot 260, i.e. the button 320 is unpressable.

Since the lock core of combination lock 400 in the unlocked state allows the control unit 200 to move along the virtual axis L (wherein the shaft 230 moves along the axis C) while the lock core of combination lock 400 in the locked state restricts control unit 200 from moving, the driving portion/wedge block 310 is moveable toward the slot 260 only when the lock core of combination lock 400 is unlocked, wherein the control unit 200 is pushed to move along the virtual axis L and away from the fastener 100, i.e. the user can press the button 320. When the lock core of combination lock 400 is locked, the lock core 400 and the control unit 200, especially the driving portion 260 restricts the displacement of the driving portion/wedge block 310, i.e. the user cannot press the button 320.

Figure 9A:
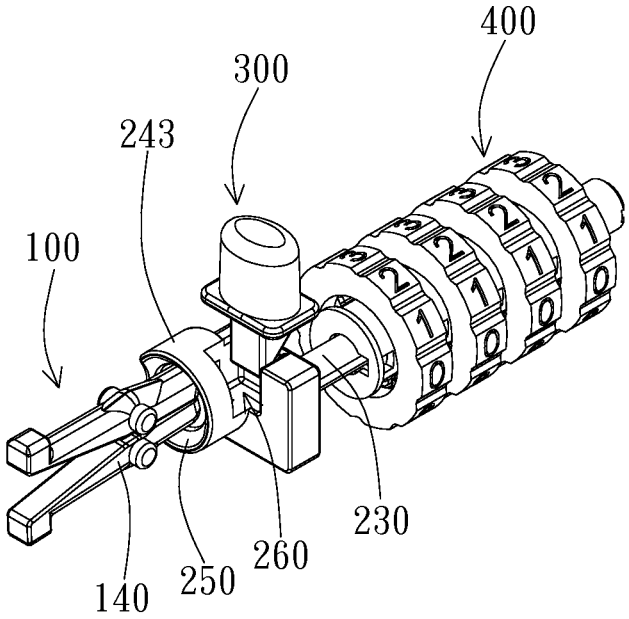
FIG. 9A and FIG. 9B are respectively a three-dimensional view and a side view of the second embodiment of the burglarproof device of the present invention in the original status with the housing being removed.
Figure 9B:
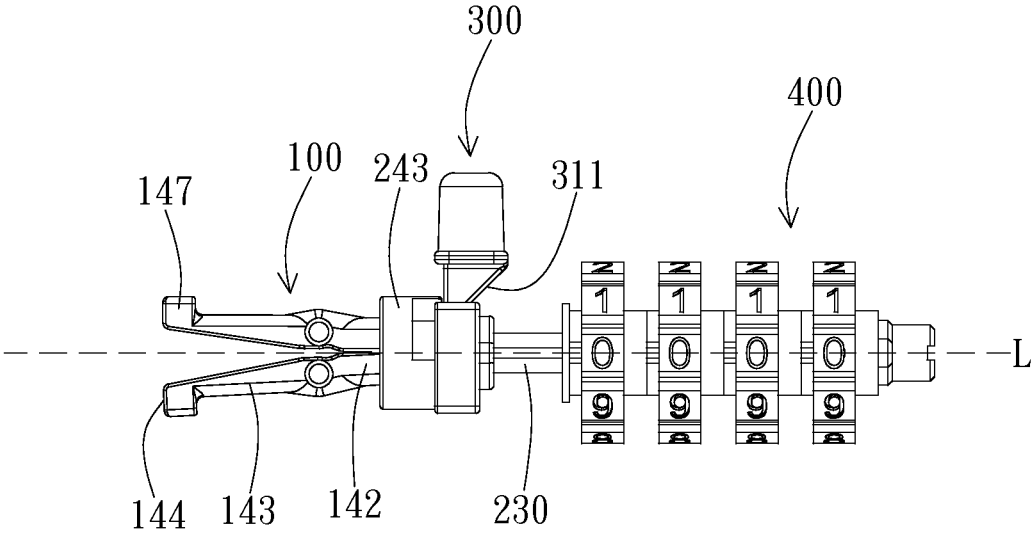

When the burglarproof device **10*b* is in an original status, as shown in FIG. 7A and FIGS. 9A-9B, the tubular controlling portion 240 of the control unit 200 contacts against the free ends of the effort arms 142 through the inner wall of the funnel 250 or an inner wall. In other words, the cylindrical tube 243 gathers two effort arms 142 so that the resistance arms 143 move away from each other. At the same time, the elastic member 500 disposed among the effort arms 142 is compressed by the effort arms 142** and deformed with a restoring force for returning to an initial status.

On the other hand, the front ends 144 of the resistance arms 143 are away from each other. The plurality of projections 147 spread radially from the virtual axis L, wherein the ends of the projections 148 spread to a degree of not able to pass through the hole 911 of the housing 910 of the electronic device.

Figure 10A:
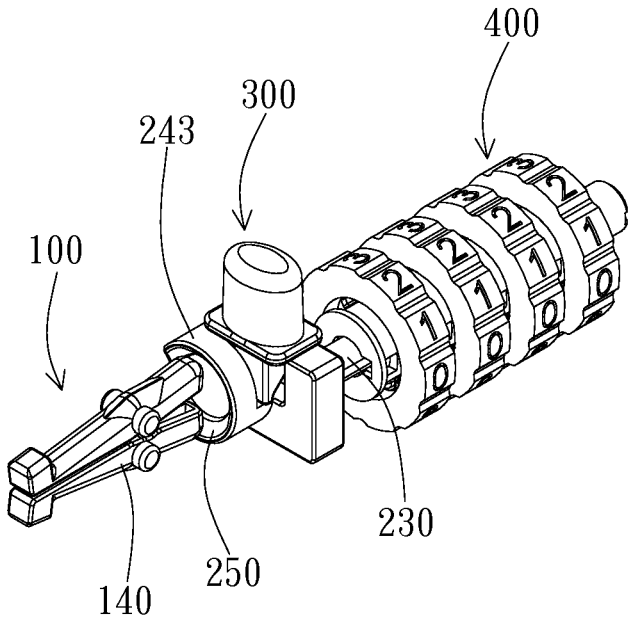
FIG. 10A and FIG. 10B are respectively a three-dimensional view and a side view of the second embodiment of the burglarproof device of the present invention in the connecting-permissible status with the housing being removed.
Figure 10B:
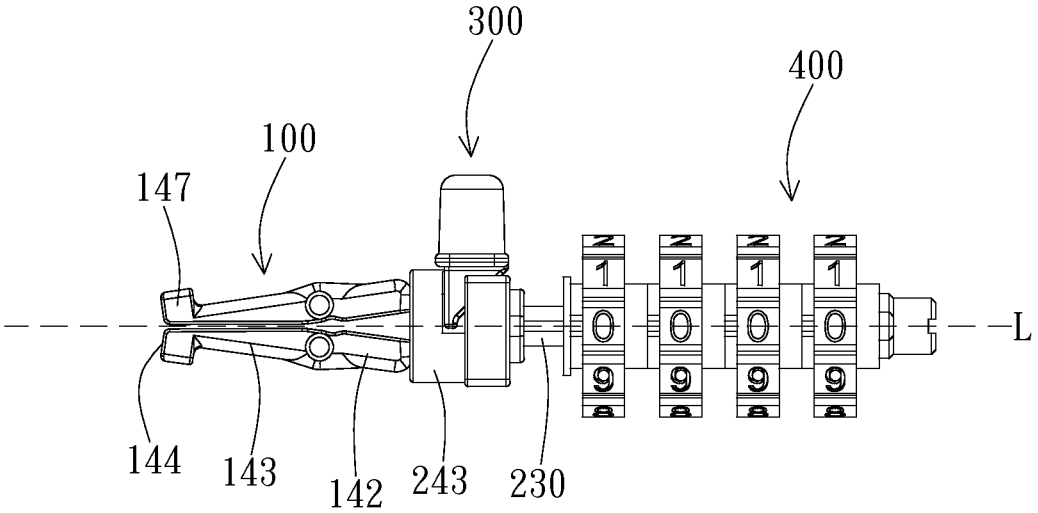

When the burglarproof device **10*b* is in the original status, one end of the driving portion/wedge block 310 is located near an entrance of the slot 260. When the lock core of combination lock 400 of the burglarproof device 10*b* in the original status is unlocked, the driving portion/wedge block 310 may move toward the slot 260 to push the control unit 200 to move along the virtual axis L and away from the fastener 100. As shown in FIG. 7B and FIGS. 10A-10B, the cylindrical tube 243 moves away from the effort arms 142 along with the control unit 200 moving away from the fastener 100. Meanwhile, the cylindrical tube 243 no longer confines the two effort arms 142 coming closer to each other, i.e. the confinement of the free ends of the effort arms 142 by the inner wall of the cylindrical tube 243 is released. At the same time, the elastic member 500 is released to the initial status and pushes the free ends of the effort arms 142 to be restored to a state of being away from each other due to the restoring force. On the other hand, the projections 147 located at the front ends 144 of the plurality of resistance arms 143 gather at the virtual axis L, which allow themselves to get across the hole 911 of the housing 910 of the electronic device. At the same time, the burglarproof device 10*b* is in the connecting-permissible status and is allowed to be detached from the hole 911 of the housing 910 of the electronic device. Alternatively, the burglarproof device 10*b*** is allowed to be connected to the electronic device.

On the contrary, when the oblique plane 311 of the driving portion/wedge block 310 no longer pushes against the slow wall 261, e.g. the pressing of the button is released, it is preferred that the control unit 200 moves along the virtual axis L and toward the fastener 100, e.g. the control unit 200 is pushed by the restoring force of the elastic member 500. At the same time, the cylindrical tube 243 also moves toward the effort arms 142. The cylindrical tube 243 starts in contacting the free ends of the effort arms 142 from the inner wall of the funnel 250, the free ends of the effort arms 142 then move toward each other and along the inner wall of the funnel 250. The two effort arms 142 are preferably gathered in the cylindrical tube 243. At the same time, the front ends 144 of the resistance arms 143 move away from each other, wherein the plurality of projections 147 previously gathering at the virtual axis L spread radially. In the case that the fastener 100, i.e. the resistance arm 143 of the lever arm 140 has been inserted into the hole 911, when the ends of the projections 148 spread to the degree of not able to pass through the hole 911 of the housing 910 of the electronic device, the housing 910 of the electronic device interferes with the hook portion 149. That is, the burglarproof device 10*b* is unable to be pulled out of the hole 911 of the housing 910. Meanwhile, it is able to further perform the locking operation of the lock core of combination lock 400 to make the burglarproof lock 10*b* be in the locked status.

Figure 11:
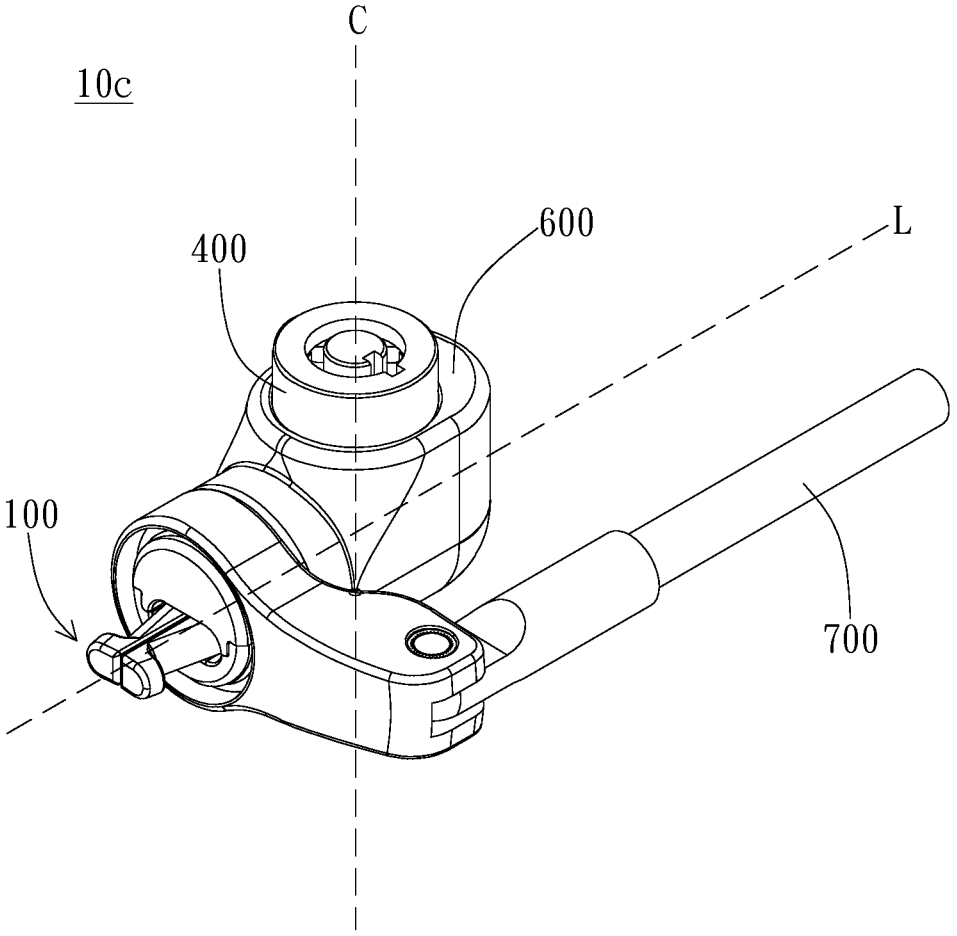
FIG. 11 shows a three-dimensional view of the third embodiment of the burglarproof device of the present invention.
Figure 12:
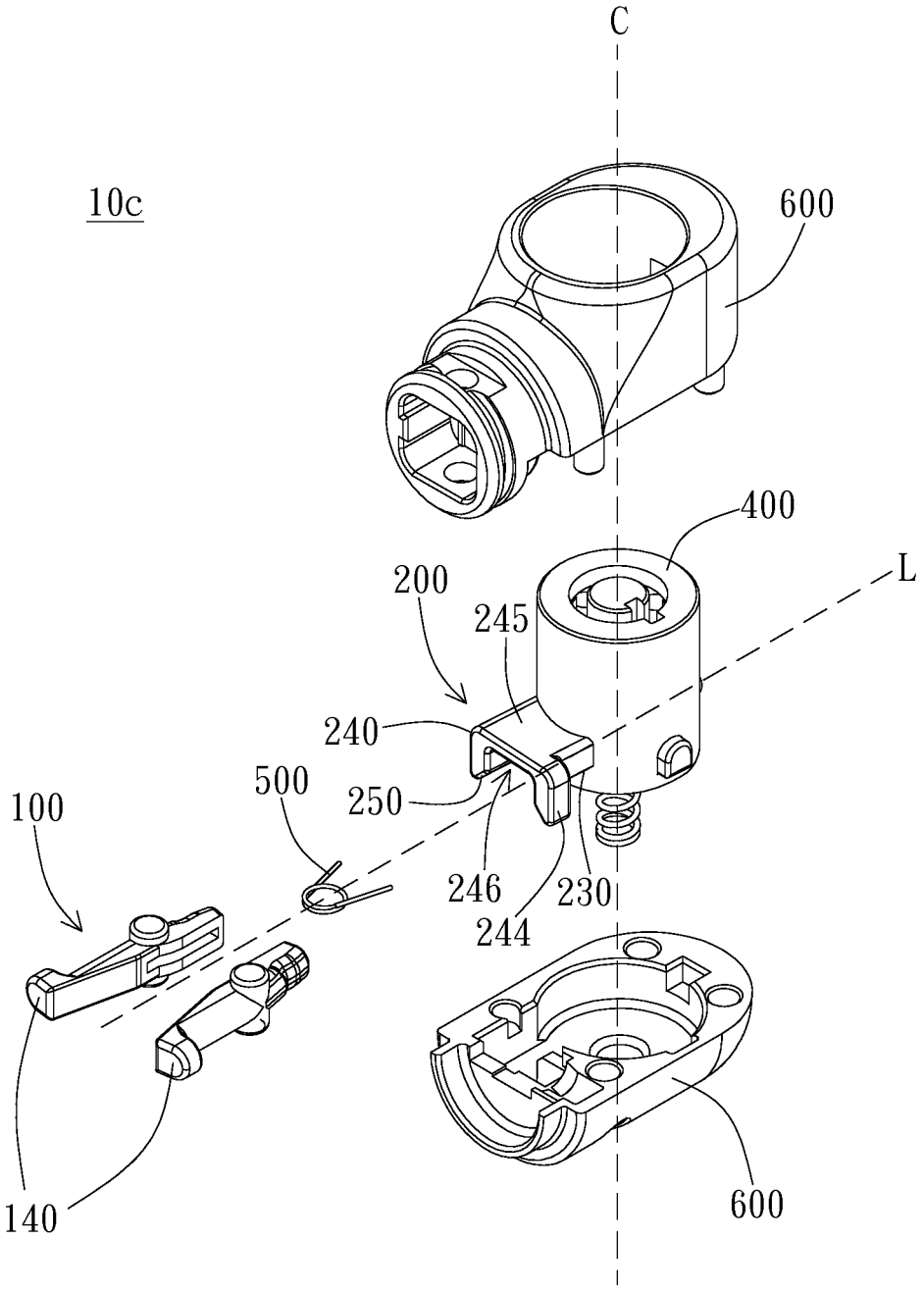
FIG. 12 is an exploded view of the third embodiment of the burglarproof device of the present invention.

In the another embodiment of the invention, as shown in FIGS. 11-12, the burglarproof device 10*c* has the fastener 100, the control unit 200, the lock core of key lock 400, and the housing 600, wherein the lock core 400 may move along the axis C during the unlocking and locking operation.

As mentioned above, the fastener 100 of the embodiment includes the plurality of lever arms 140 (two lever arms are shown in the figure), which preferably evenly surround the virtual axis L. In the embodiment, the virtual axis L and the axis C may be perpendicular to each other. The elastic member 500 is disposed between the effort arms 142 of the two lever arms 140.

In the embodiment, the control unit 200 is aside the effort arms 142 of the two lever arms 140 of the fastener 100 and includes the connecting portion 230 and the controlling portion 240, wherein "being aside" means an orientation of 90 degrees with respect to the above-mentioned outer side with reference to the virtual axis L. The connecting portion 230 is for connecting the above-mentioned lock core/key lock 400. By operating the key lock 400, the control unit 200 may move relative to the two effort arms 142 of the fastener 100 along or parallel to the axis C to approach or leave the fastener 100.

The controlling portion 240 operates the fastener 100 to be in the connecting-permissible status or the locked status and may include the structure of wedge block as shown in the figure. For example, the controlling portion 240 of the embodiment further includes a plate 245 extending from the lock core of key lock 400, at least two wedge blocks 244 are disposed on opposite sides of the plate 245 in a way of the oblique planes of the wedge blocks 244 facing each other and correspond to the effort arms 142 of the two lever arms 140, respectively; wherein the oblique plane of the wedge block 244 serve as the guiding surface 250. In addition, an interval between the two wedge blocks 244 is preferably greater than the sum of length of the free ends of the two effort arms 142 along the direction perpendicular to the virtual axis L.

In other words, the two wedge blocks 244 and the plate 245 constitute a U-shaped structure. The two effort arms 142 may be eventually gathered in the U-shaped structure 246 along with a displacement of the control unit 200 along or parallel to the axis C toward the two effort arms 142.

Figure 13A:
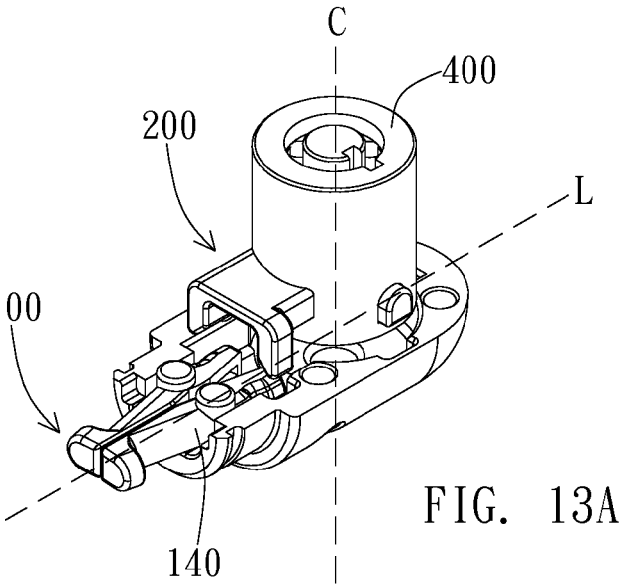
FIG. 13A is a three-dimensional view of the third embodiment of the burglarproof device of the present invention in the connecting-permissible status (the original status) with a portion of the housing being removed.
Figure 13B:
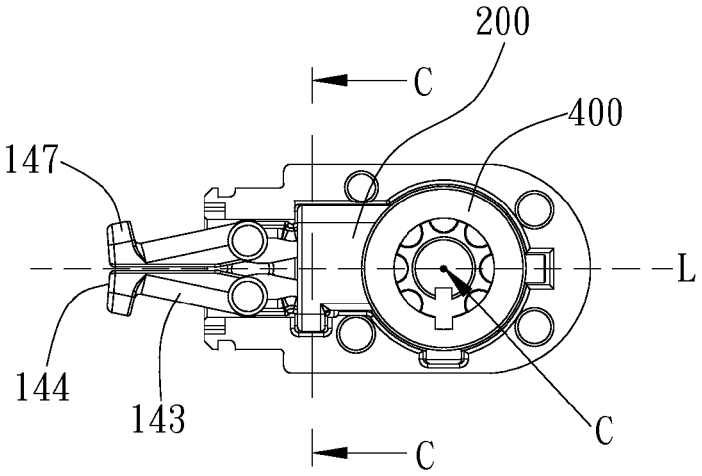
FIG. 13B is a top view of FIG. 13A.
Figure 13C:
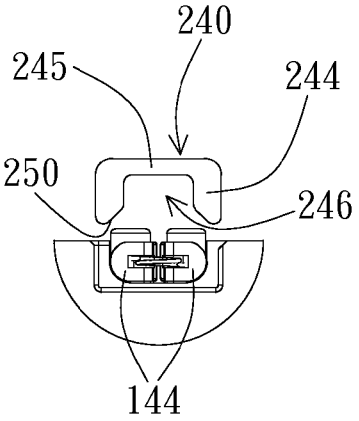
FIG. 13C is a cross-sectional view along the cross-sectional line CC in FIG. 13B.

When the burglarproof device 10*c* is in the connecting-permissible status, as shown in FIGS. 13A-13C, the elastic member 500 makes the free ends of the effort arms 142 of the plurality of lever arms 140 move away from each other, i.e. the front ends 144 of the resistance arms 143 approach to each other. Meanwhile, the projections 147 located at the front ends 144 of the plurality of resistance arms 143 gather at the virtual axis L so that the shape and the diameter of the gathering projections 147 in a radial direction with respect to the virtual axis L allow themselves to get across the hole 911 of the housing 910 of the electronic device. On the other hand, the control unit 200 is away from the two effort arms 142.

When performing the locked operation of the lock core of key lock 400, the lock core 400 may drive the connecting portion 230 so that the control unit 200 moves relative to the two effort arms 142 of the fastener 100 and approach the two effort arms 142. The control unit 200 will contact the free ends of the effort arms 142 from the guiding surfaces 250 of the controlling portion 240. By means of the continuous driving of the above-mentioned key lock 400 along/parallel to the axis C, the control unit 200 moves relative to the fastener 100 and approaches the fastener 100, the guiding surfaces 250 push against the free ends of the two effort arms 142 so that the effort arms 142 move along the guiding surfaces 250 and simultaneously approach to each other; in other words, two effort arms 142 are gradually gathered together between the two wedge blocks 244.

Figure 14A:
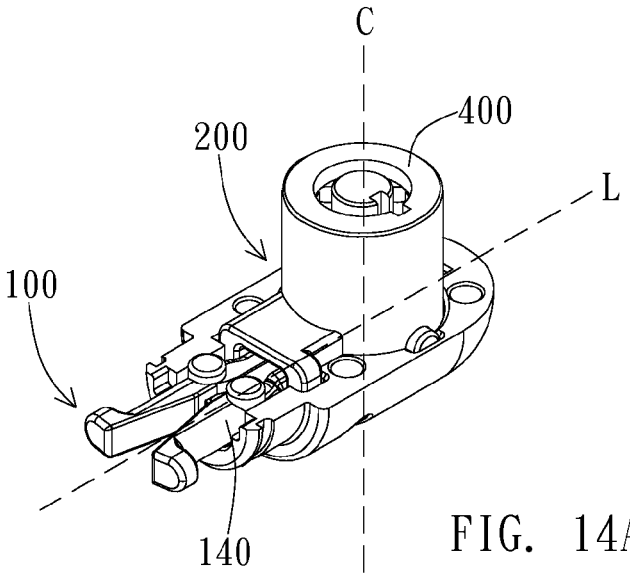
FIG. 14A is a three-dimensional view of the third embodiment of the burglarproof device of the present invention in the locked status with a portion of the housing being removed.
Figure 14B:
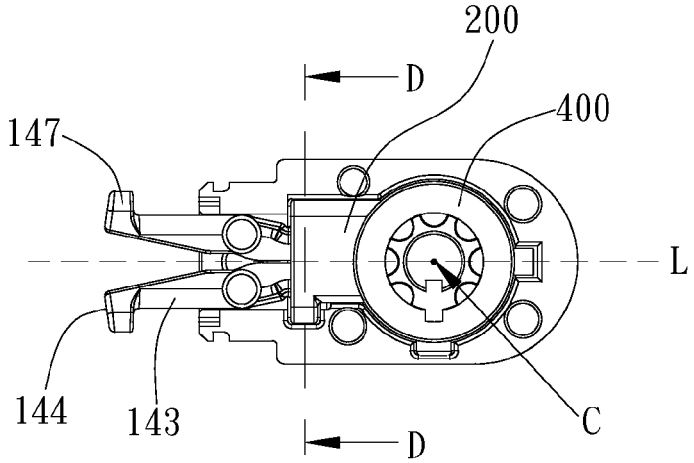
FIG. 14B is a top view of FIG. 14A.
Figure 14C:
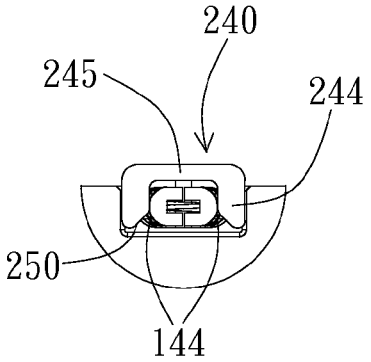
FIG. 14C is a cross-sectional view of along the cross-sectional line DD in FIG. 14B.

As FIGS. 14A-14C show, two effort arms 142 are eventually gathered in the U-shaped structure 246, i.e. between the two wedge blocks 244. On the other hand, the plurality of projections 147 previously gathering at the virtual axis L spread radially therefrom. When the fastener 100, especially the resistance arm 143 of the lever arm 140, has been inserted into the hole 911, the ends of the projections 148 spread to a degree of not able to pass through the hole 911 of the housing 910 of the electronic device, the burglarproof device 10*c* cannot be pulled out of the hole 911 of the housing 910 and the burglarproof device 10*c* is in the locked status.

Although the preferred embodiments of present invention have been described herein, the above description is merely illustrative. The preferred embodiments disclosed will not limit the scope of the present invention. Further modification of the invention herein disclosed will occur to those skilled in the respective arts and all such modifications are deemed to be within the scope of the invention as defined by the appended claims.

What is claimed is:

1. A burglarproof device for electronic device, comprising:

a fastener comprising a plurality of lever arms surrounding a virtual axis;

a control unit moving relative to the fastener and driving ends of the lever arms to move toward each other when the control unit approaching the fastener; the ends of the lever arms moving away from each other when the control unit leaving the fastener; and a lock core, wherein when the lock core is unlocked, the control unit is allowed to move relative to the fastener, and when the lock core is locked, the control unit is restricted from moving relative to the fastener.

2. The burglarproof device of claim 1, wherein each of the lever arms has a pivot, an effort arm beside the pivot, and a resistance arm beside the pivot and opposite to the effort arm; the pivots are disposed close to each other and surround the virtual axis.

3. The burglarproof device of claim 2, wherein the effort arm, the pivot, and the resistance arm constitute the lever arm having a V shape.

4. The burglarproof device of claim 2, wherein the control unit is next to the effort arm of the fastener and includes a guiding surface, the guiding surface pushes against the effort arms to move toward each other when the control unit approaches the fastener.

5. The burglarproof device of claim 4, wherein the effort arm has a free end away from the pivot; the resistance arm has a front end away from the pivot; the burglarproof device further comprises an elastic member disposed among the effort arms; the elastic member applies force to the effort arms so that the free ends are distant from each other; the elastic member is compressed and deformed when the effort arms move toward each other.

6. The burglarproof device of claim 5, wherein a projection is formed on an outer side of the front end, an end of the projection constitutes a hook portion.

7. The burglarproof device of claim 4, wherein the control unit includes a connecting portion and a controlling portion; the guiding surface is located at the controlling portion; the controlling portion includes a structure selected from the group consisting of a wedge block and a tube; the guiding surface is selected from the group consisting of an oblique plane and an inner wall of a funnel.

8. The burglarproof device of claim 7, wherein a plurality of wedge blocks correspond to the effort arms, respectively; each of the wedge blocks has an oblique plane as the guiding surface.

9. The burglarproof device of claim 7, wherein one end of the tube is connected to the effort arms; an inner wall of the tube at the one end is formed as the inner wall of the funnel, drawn close in a direction away from the fastener, and serves as the guiding surface.

10. The burglarproof device of claim 7, wherein the connecting portion connects the controlling portion and the lock core.

11. The burglarproof device of claim 7, wherein the connecting portion is a shaft of the lock core and participating in an unlocking operation and a locking operation of the lock core.

12. The burglarproof device of claim 2, further comprising a housing, wherein the control unit, the lock core, and at least a portion of the fastener are received in the housing; at least a portion of the resistance arms protrudes out of the housing.

13. A burglarproof device for electronic device, comprising:

a fastener comprising a plurality of lever arms surrounding a virtual axis;

a control unit moving relative to the fastener and having a guiding surface, wherein the guiding surface guides ends of the lever arms to move along the guiding surface and move toward each other when the control unit approaches the fastener; the ends of the lever arms move away from each other when the control unit leaves the fastener; and a lock core, wherein a locking operation of the lock core drives the control unit to approach the fastener, an unlocking operation of the lock core drives the control unit to leave the fastener.

14. The burglarproof device of claim 13, wherein the control unit is connected to the lock core; the lock core moves during the locking operation and the unlocking operation and drives the control unit to move relative to the fastener.

15. The burglarproof device of claim 13, wherein the control unit includes a shaft participating in the unlocking operation and the locking operation; the unlocking operation drives the shaft to move along an axis and away from the fastener, the locking operation drives the shaft to move along the axis and toward the fastener; the axis is substantially parallel to the virtual axis.

16. A burglarproof device for electronic device, comprising:

a fastener comprising a plurality of lever arms surrounding a virtual axis;

a control unit moving relative to the fastener and having a guiding surface, wherein the guiding surface guides ends of the lever arms to move along the guiding surface and move toward each other when the control unit approaches the fastener; the ends of the lever arms move away from each other when the control unit leaves the fastener;

an operating device driving the control unit to move relative to the fastener; and a lock core, wherein when the lock core is unlocked, the operating device is operable, and when the lock core is locked, the operating device is restricted.

17. The burglarproof device of claim 16, wherein each of the lever arms has a pivot, an effort arm beside the pivot, and a resistance arm beside the pivot and opposite to the effort arm; the pivots are disposed close to each other and surround the virtual axis.

18. The burglarproof device of claim 17, wherein the control unit includes a connecting portion, a controlling portion, and a driven portion; the driven portion interacts with the operating device.

19. The burglarproof device of claim 18, wherein the operating device contacts with the driven portion and drives the control unit to leave the fastener; the control unit gathers the effort arms and let the resistance arms be departed from each other, wherein the control unit moving away from the fastener enables the effort arms to move away from each other and the resistance arms to move toward each other.

20. The burglarproof device of claim 19, wherein the effort arm has a free end away from the pivot, the resistance arm has a front end away from the pivot; the burglarproof device further comprises an elastic member disposed among the effort arms; the elastic member applies force to the effort arms so that the free ends are distant from each other; the elastic member is compressed and deformed when the effort arms move toward each other.

21. The burglarproof device of claim 18, wherein the operating device has a driving portion, the driving portion includes a wedge block; the driven portion is a slot formed in the control unit, the slot corresponds to the driving portion and receives at least a portion of the driving portion.

22. The burglarproof device of claim 21, wherein pressing the operating device drives the driving portion to push against a wall of the slot and pushes the control unit to leave the fastener.

23. The burglarproof device of claim 18, wherein the controlling portion has a tubular structure; one end of the tubular structure is connected to the effort arms; an inner wall of the tubular structure at the one end is formed as an inner wall of a funnel, drawn close in a direction away from the fastener, and serves as the guiding surface; the tubular structure gathers the effort arms when the control unit approaches the fastener.

24. The burglarproof device of claim 18, wherein the connecting portion is a shaft of the lock core and participating in an unlocking operation and a locking operation.

* * * * *